US005327904A

United States Patent [19]

Hannum

[11] Patent Number: 5,327,904

[45] Date of Patent: Jul. 12, 1994

[54] HYPERBARIC OXYGEN CHAMBER, METHOD, AND DOOR ASSEMBLY THEREFOR

[76] Inventor: James E. Hannum, 2118 "B" Acama, Anaheim, Calif. 92802

[21] Appl. No.: 822,303

[22] Filed: Jan. 17, 1992

[51] Int. Cl.[5] ..... A61G 10/00; A62B 31/00; A62B 18/02

[52] U.S. Cl. ..... 128/205.26; 128/202.12; 128/205.25; 49/158

[58] Field of Search ..... 49/149, 158, 463; 128/202.12, 205.26, 204.18, 205.25; 272/99

[56] References Cited

U.S. PATENT DOCUMENTS

| | | | |
|---|---|---|---|
| 887,167 | 5/1908 | Wilkes | 49/158 |
| 1,011,734 | 12/1911 | Brown et al. | 49/149 |
| 1,910,344 | 5/1933 | Kotler | 49/463 |
| 2,527,367 | 10/1950 | May | 49/149 |
| 3,146,500 | 9/1964 | Volkert | 49/149 |
| 3,318,047 | 5/1967 | Carson | 49/149 |
| 3,497,999 | 3/1970 | Hendra | 49/149 |
| 4,727,870 | 3/1988 | Krasle | 128/202.12 |
| 4,879,843 | 11/1989 | Hamamoto et al. | 49/158 |
| 4,974,829 | 12/1990 | Gamow et al. | 272/3 |

FOREIGN PATENT DOCUMENTS

| | | | |
|---|---|---|---|
| 293608 | 1/1971 | U.S.S.R. | 128/205.26 |
| 1219678 | 1/1971 | United Kingdom | 128/205.26 |

*Primary Examiner*—Edgar S. Burr
*Assistant Examiner*—Kimberly L. Asher
*Attorney, Agent, or Firm*—Harry M. Weiss

[57] ABSTRACT

A hyperbaric oxygen chamber, comprising two pressure vessel heads connected by a cylindrical wall wherein the diameter of the cylindrical wall permits a patient to sit within the chamber and permits the chamber to fit through a standard double door opening in a direction perpendicular to the axis of the wall.

3 Claims, 2 Drawing Sheets

HYPERBARIC OXYGEN CHAMBER, METHOD, AND DOOR ASSEMBLY THEREFOR

BACKGROUND OF THE INVENTION

This invention relates to chambers for hyperbaric oxygen therapy. Hyperbaric oxygenation is a mode of medical treatment in which the patient is entirely enclosed in a pressure chamber breathing oxygen at a pressure greater than one atmosphere.

Hyperbaric oxygen therapy began during the 1930's with Navy studies on the use of oxygen to more rapidly decompress divers and to treat those divers suffering from decompression sickness. Since that time, studies on the efficacy and proper utilization of hyperbaric oxygen therapy have greatly expanded the role of hyperbaric oxygen therapy in modern medicine.

Besides being essentially the only accepted treatment for decompression sickness, hyperbaric oxygen therapy has also become accepted as a primary or adjunctive therapy for decubitus ulcers, radiation necrosis, acute carbon monoxide poisoning, acute gas embolism, gas gangrene, refractory osteomyelitis, crush injuries with acute traumatic ischemia, acute cyanide poisoning and acute cerebral edema. Furthermore, studies are presently being conducted to determine the efficacy of hyperbaric oxygen therapy in the treatment of thermal burns, bone grafting, acute carbon tetrachloride poisoning, fracture healing, multiple sclerosis, sickle cell anemia and numerous other conditions.

The cost of hyperbaric oxygen therapy limits its use in treating the conditions for which hyperbaric oxygen therapy has proved to be effective, and drastically limits the scope of studies into further potential benefits from hyperbaric oxygen therapy. Typically, a patient undergoes hyperbaric oxygen therapy for a period of about an hour while lying within a mono-place chamber pressurized with pure oxygen, or while sitting or standing within a multi-place chamber pressurized with compressed air while breathing pure oxygen through a mask.

Mono-place hyperbaric oxygen chambers are generally elongate, horizontal cylinders pressurized with pure oxygen in which the patient must lie in the prone position. Although these mono-place chambers are considerably less expensive to construct and operate than the larger multi-place chambers, they are still relatively expensive. This is due to the expense involved in manufacturing an outwardly opening door mechanism which is capable of maintaining a proper seal while the chamber is pressurized and the cost of fabricating and maintaining the double-walled plastic cylinder used to form the chamber.

Mono-place hyperbaric oxygen chambers are also expensive to operate. Since patients are slid into the end of mono-place chambers on a gurney, the room used to house the chamber must be longer than the length of the chamber plus the length of the gurney. This space requirement typically makes it impractical for small clinics or individual physicians to administer hyperbaric oxygen therapy.

One of the major costs involved in treating a patient with hyperbaric oxygen therapy in a mono-place chamber is the cost of the oxygen. Since the entire mono-place chamber is pressurized with oxygen, and since the safety and comfort of the patient requires that the chamber be constantly ventilated, the minimum oxygen usage for such a chamber is about 240 liters per minute. However, since the only cooling typically available to offset the accumulation of body heat in the chamber is from the flow of oxygen in the chamber, oxygen usage is often as high as 500 liters per minute. The total oxygen environment of the mono-place chambers also necessitates the inclusion of variety of safety features. Substantial ventilation systems are required to ensure against carbon dioxide accumulation in the chamber. Furthermore, because of the increased flammability of most materials in a pure oxygen environment, there is always the potential for a catastrophic fire.

One example of a mono-place hyperbaric oxygen chamber is disclosed in U.S. Pat. No. 3,587,574, issued Jun. 28, 1971 to Mercer, in which an elongated tubular hermetically sealable casing having a pressure sealable door at each end and a floor structure has internal supports for a patient's bed or litter. A similar example of a transportable hyperbaric chamber is disclosed in U.S. Pat. No. 4,467,798, issued Aug. 24, 1984 to Saxon et al., in which a cylindrical chamber is adapted to be temporarily connected to a deck chamber or other emergency chamber to receive an injured person.

Another approach is disclosed in PCT Publication PC/SE79/00011, issued Aug. 9, 1979 to Ingelstedt, et al., in which a pressure sealed, rotating chamber with a cylindrical pressure-tight door on one end is used to rotate a patient to a reclined or upright sitting position for the treatment of middle ear dysfunction.

Each of these examples has a disadvantage in that they use heavy, externally mounted pressure doors to seal the chamber. these doors are expensive to manufacture and difficult to mount and operate.

Other references consulted regarding structural features but not deemed pertinent to the present invention as claimed are U.S. Pat. No. 2,292,092, issued Aug. 4, 1942 to Shankweller ("Cabinet Cover") and U.S. Pat. No. 1,169,143, issued Jan. 25 1916 to Furlong ("Door").

Treatments in mono-place hyperbaric oxygen chambers are generally disliked by patients. The patients find it very uncomfortable to lie on their backs in the chambers for the long periods required by the therapy. In addition, to the physiological discomfort caused by the treatments, patients typically experience enhanced feelings of claustrophobia during the sessions.

Although multi-place chambers are significantly more comfortable than mono-place hyperbaric oxygen chambers, in that they permit the patient to sit or stand during the treatment session, these large chambers suffer many drawbacks. Due to the size of the chambers, they cannot be prefabricated and shipped to a facility, but must be custom fabricated on site. Typically, the large chambers also require a large support staff. Due to their size and the expense involved in their manufacture, multi-place chambers are only utilized at relatively large facilities, which deal with a large number of cases wherein hyperbaric oxygen therapy is the only accepted mode of treatment. Even at these facilities, the cost of each individual therapy session greatly limits the use of hyperbaric oxygen therapy.

In view-of the foregoing, a need exists for a safe, comfortable mono-place hyperbaric oxygen chamber which is relatively inexpensive to manufacture and operate.

SUMMARY OF THE INVENTION

A hyperbaric oxygen chamber, comprising two pressure vessel heads connected by a cylindrical wall wherein the diameter of the cylindrical wall permits a patient to sit within the chamber and permits the chamber to fit through standard double door opening in a direction perpendicular to the axis of the wall.

The chamber preferably includes an inwardly opening door which utilizes the chamber's internal pressure to seal the entry to the chamber, and means which permits the door to be opened without disturbing the seated patient.

The present invention, particularly when it incorporates an inwardly opening door, is significantly less expensive to construct than existing mono-place chambers. Advantageously, the chamber is pressurized with air and not oxygen, so that it is safe and inexpensive to operate. The chamber thus provides a comfortable environment in which the patient can relax during hyperbaric oxygen treatment sessions.

DESCRIPTION OF THE DRAWINGS

These and other features of the invention will now be described with reference to drawings of the preferred embodiment which is intended to illustrate, and not to limit the invention, and in which.

DESCRIPTION OF THE PREFERRED EMBODIMENT

Figure 1:
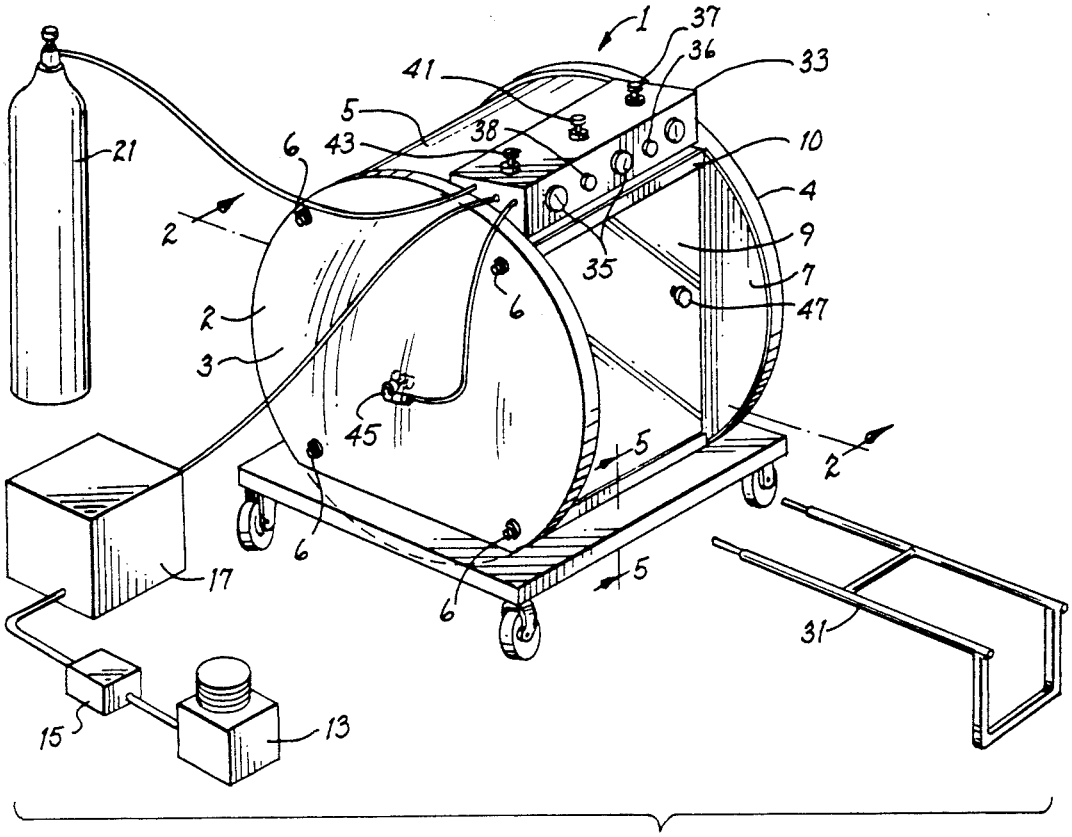
FIG. 1 is a perspective view of the hyperbaric oxygen chamber of the present invention with its accompanying support units.
Figure 3:
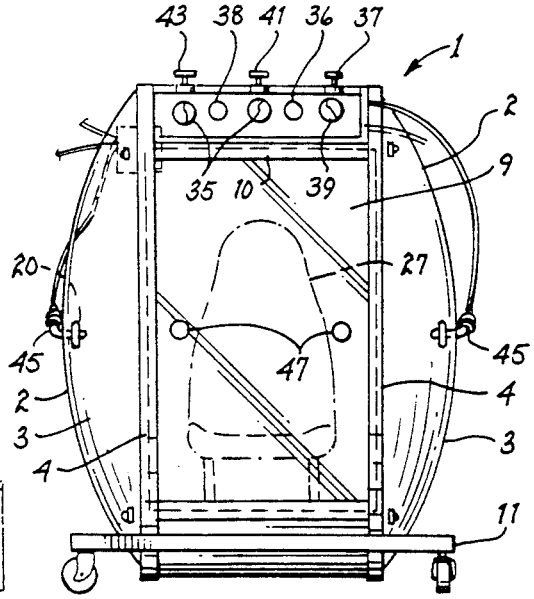
FIG. 3 is a front elevation view of the chamber of FIG. 1.

Referring to FIGS. 1 and 3, there is shown a hyperbaric oxygen chamber 1 embodying this invention. In order to minimize the bending moments and the shearing stresses on the chamber 1 due to the pressure within, the chamber would need to be of a spherical shape. However, in order to obtain a chamber which permits a patient to sit upright within it and fit within a standard double door opening, a modified spherical design is used.

The chamber preferably utilizes a pair of standard ASME hydro-pressed, concave-to-pressure, steel, pressure vessel heads 3 with a spherical surface 2 having a radius of approximately 60 inches and a narrow cylindrical lip 4 having an internal diameter of approximately 60 inches. Thus, the ratio between the diameter of the spherical surface 2 and the diameter of tile lip 4 is approximately 2:1. Each of the heads 3 preferably has an overall depth of approximately 9 inches, including the approximately 2 inch width of the cylindrical lip 4. The bend between the closed end of the head 3 and the lip 4 reinforces the rigidity of the chamber 1.

Figure 2:
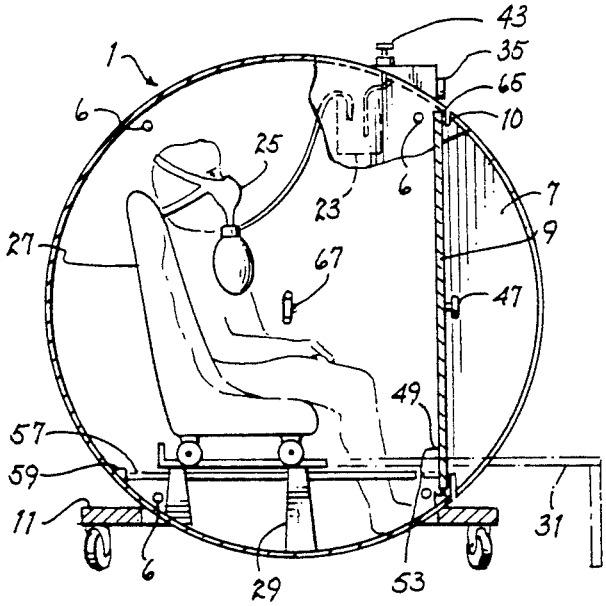
FIG. 2 is a sectional view of the chamber on line 2—2 of FIG. 1.

The two heads 3 are connected by a wall 5 which has a cylindrical curvature that extends only about 270°, thus having a generally C-shaped cross section, as seen from FIGS. 1 and 2. The circumferential ends of the wall 5 are spaced vertically from each other to define the upper and lower edges of a rectangular door opening.

The external diameter of the wall 5 is approximately equal to that of the internal diameter of the head lips 4. The exterior of the cylindrical wall 5 is sealably secured to the interior cylindrical surface of the lips 4 so that the lips 4 prevent the wall 5 from deforming outward when the chamber 1 is pressurized. The width, i.e. axial length, of the cylindrical wall 5 is such that the entire chamber can fit through a standard double door opening of about 72 inches in a direction perpendicular to the axis of the cylindrical wall 5. Preferably, however, the chamber can fit through a standard single door opening in a direction perpendicular to the axis of the cylindrical wall 5. More specifically, the entire chamber dimension is preferably no more than 36 inches. This means that the axial length of the cylindrical wall is no more than about 22 inches in view of the 7 inch axial length of each of the heads. Furthermore, if the wall 5 is sealably secured to the lips 4 by means of bolts 4, the heads 5 can be removed so that the chamber can be fitted through an even smaller door opening.

Figure 4:
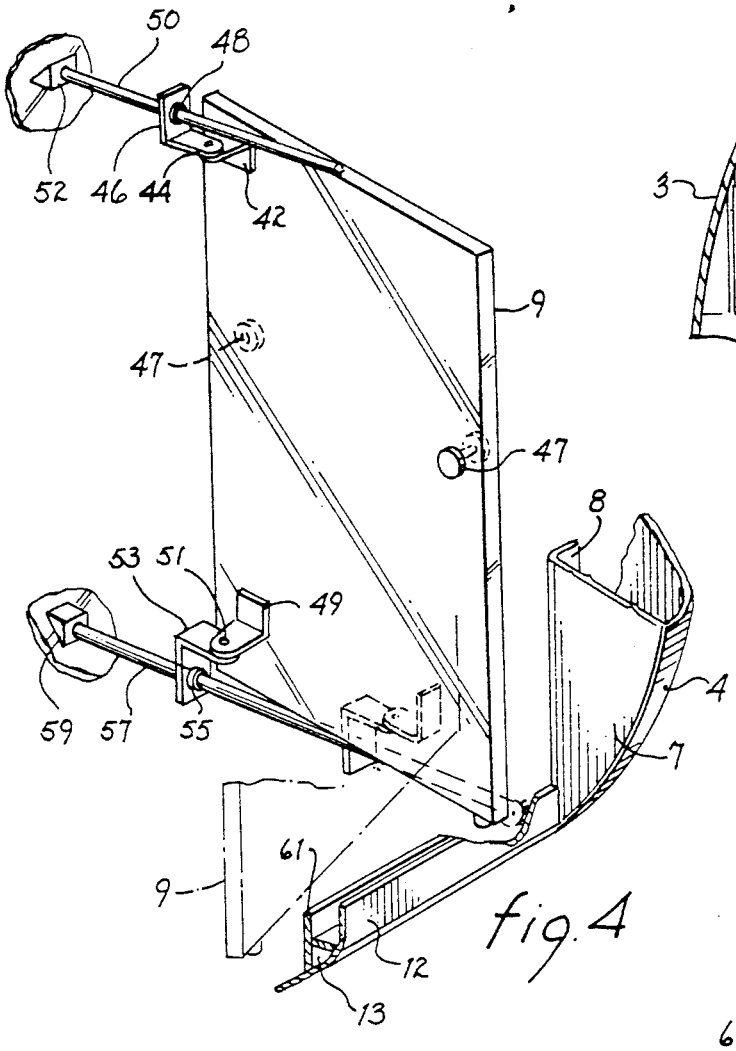
FIG. 4 is a perspective view of the door assembly of the chamber of FIG. 1.

A pair of plates 7 having the shape of circular segments form vertical side walls of the door opening. More specifically, the long curved edge of each of the plates 7 is secured to the interior of one of the lips 4 while the straight edges of the plates 7 together with the horizontal circumferential edges of the wall 5 form the door opening. ]Extending at right angles to the vertical edge of such plates is a narrow flange 8, as shown in FIG. 4, directed towards the adjacent head 3. The flange 8 gives the plate 7 extra rigidity to prevent it from deforming when the chamber 1 is pressurized.

The joint between the head lips 4 and the wall 5 is reinforced by a group of tie rods 6 running parallel to the axis of the wall 5 and spaced equidistant about the periphery of the heads 3 so that they extend within the chamber along the interior of wall 5 and through both heads 3. The rods 6 are held in place by suitable fastening means, such as nuts.

Figure 5:
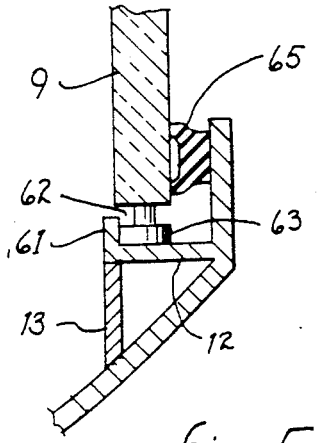
FIG. 5 is an enlarged partial sectional view taken along 5—5 of FIG. 1 illustrating the horizontal track of the door assembly.

An upper door frame member 10 having an angular cross section forming an internal angle of approximately 135° is secured by one leg to the interior of the upper edge of the wall 5, extending parallel to the wall's axis, while the other edge extends vertically. A lower frame member 12 defining an interior angle of 90° is secured along its outer angular edge to the lower edge of the wall 5 parallel to the wall's axis so that one of its sides extends vertically and the other horizontally towards the interior of the chamber. The frame member 12 is supported in this position by a rectangular plate 13 which extends between the inner edge of the horizontal side of the frame member 12 and the wall 13 as best seen in FIG. 5. The angular frame members 10 and 12, act to reinforce the rigidity of the chamber 1 and, along with the plates 7, define the chamber's rectangular entry or door frame.

A transparent rectangular door 9, having a thickness of approximately one inch and made from an extremely resilient shatterproof material is positioned within the chamber 1 and has a height and width slightly greater than that of the chamber's entry.

Referring to FIG. 4, attached to the door 9 are three hand grips 47. One of the large flat outer legs of a generally L-shaped bracket 49 is secured to the interior surface of the entry door 9 so that the other large flat leg of the bracket 49 extends horizontally outward from the door 9. A pin 51 fits within a bore in the horizontally extending leg of bracket 49 and rotatably secures the outer leg of the bracket 49 against one of the legs of a second generally L-shaped bracket 53. The other leg of the bracket 53 extends vertically downward and contains a bore, along the edges of which is secured a lineal bearing 55. This lineal bearing 55 is slideably mounted around a horizontal guide rod 57 which runs from the front to the rear of the chamber 1 and is secured to the chamber by a pair of supports 59, one of which is seen in FIGS. 2 and 4.

One of the large, flat, outer legs of a generally L-shaped bracket 42 is secured to the interior surface of the entry door 9 so that the other large, flat leg of the bracket 42 extends horizontally outward from the door. A pin 44 fits within a bore and the horizontally extending leg of the bracket 42 and rotatably secures the outer leg of the bracket 42 against one of the legs of the second generally L-shaped bracket 46. The other leg of the bracket extends vertically upward and contains a bore, along tile edges of which is secured a lineal bearing 48. This lineal bearing 48 is slideably mounted around a horizontal guide rod 50 which runs from the front to tile rear of the chamber 1 and is secured to the chamber by a pair of supports 52, one of which is seen in FIGS. 2 and 4.

Referring to FIGS. 4 and 5, a thick resilient gasket 65 made of rubber or similar material extends around the door frame, being secured to the interior of the vertical flanges 8 and upper and lower frame members 10 and 12. A narrow rectangular guide strip 61 is secured to the upper interior edge of the horizontal frame member 12 spaced inward from the vertical leg of the member 12 so as to form a horizontal track 62 therebetween. Attached to the lower edge of the door 9 at the corner distal the bracket 49 is a disc-shaped guide 63 which has a diameter slightly less than the horizontal distance between the guide strip 61 and the proximate vertical surface of tile door gasket 65.

As shown in FIGS. 2 and 3, a seat 27 sits upright within the chamber upon a pedestal support 29. Preferably, the pedestal 29 incorporates a pair of parallel horizontal hollow rods into which can be inserted the narrow ends of a generally L-shaped seat guide 31, FIG. 1.

The chamber 1 is preferably supported on a rectangular dolly 11 which allows the chamber to be rolled in all directions.

A standard air pump 13 is connected to the chamber 1 by connecting tubing. Preferably, a charcoal air filter 15 and a refrigeration unit 17 are connected to the chamber in series with the air pump 13. The tubing is connected to an adjustable top nozzle 18 (shown in FIG. 6) and an adjustable side nozzle 20 (shown in FIGS. 1 and 3).

An external pressurized oxygen source 21 is connected to a humidifier 23 within the chamber 1 by connecting tubing. More tubing connects the humidifier 23 to an oxygen mask 25 (shown in detail in FIG. 6).

Figure 7:
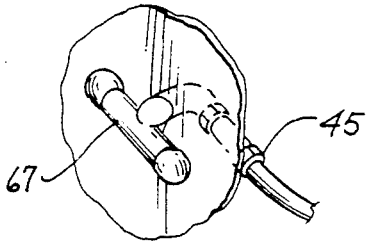
FIG. 7 is a perspective view of the chamber's filtered ventilation outlet.

A control panel 33 is secured to the exterior surface of the wall 5 immediately adjacent the upper door frame member 10. A pair of pressure gauges 35 secured to the panel 33 measure the atmospheric pressure within the chamber 1. The amount of air exiting the chamber 1 is controlled by a chamber outflow control valve 37. A third gauge 39 is utilized to measure the pressure on the manifold of the outflow control valve 37. The chamber 1 also incorporates a bleed valve 41 for gradually releasing the pressure within the chamber 1, and a full release valve 43 for rapidly decreasing the pressure within the chamber 1. The chamber 1 also incorporates a pair of check valves 45 which prevent the inadvertent rapid decompression of the chamber 1, as seen in FIG. 3. Referring to FIG. 7, a screened T-shaped ventilation outlet 67 is downstream from the check valve 45.

The operation of the hyperbaric oxygen chamber 1 will now be described. The chamber door 9 is opened by pushing the handgrip 47 proximate the bracket 49 toward the back of the chamber 1 and, at the same time, pulling the exterior handgrip 47 proximate the guide 63 horizontally towards the front of the guide rod 53. This causes one edge of the door to move rearwardly with the brackets, 46 and 53, and their gaskets, 48 and 55, moving along their guide rods 50 and 57. Simultaneously, the guide 63 near the other edge of the door slides within the track 62 towards the front end of the guide rod 57 (as shown in phantom in FIG. 4). This maneuver is continued until the door 9 is in its fully open position as shown in FIG. 4.

At this point, the seat guide 31 is inserted into the hollow rods of the pedestal 29. The seat 27 is rolled along the rods of the pedestal 29 and the seat guide 31 to a point outside of the chamber 1. The patient is placed in the seat 27 and is rolled into the chamber 1. The seat guide 31 can then be removed.

Figure 6:
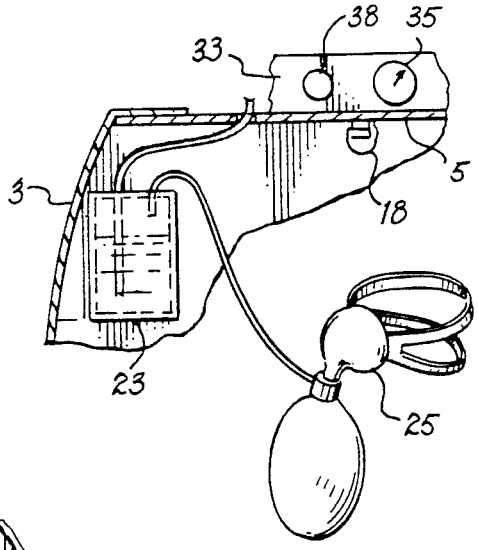
FIG. 6 is a perspective view of the humidifier and oxygen mask utilized in the chamber.

The valve on the pressurized oxygen source 21 is then opened, causing the oxygen to flow through the connecting tubing to the humidifier 23, which is shown in detail in FIG. 6. As the oxygen exits the connecting tubing within the humidifier 23, it is moistened as it rises to the surface of the water within the humidifier 23. The pressure created within the covered humidifier 23 then forces the oxygen through the tubing which connects the humidifier 23 to the oxygen mask 25. The oxygen mask 25 is positioned over the patient's head, as shown in FIG. 2, thereby providing the patient with a constant source of pure oxygen. By providing the chamber with a humidifier mucus membrane irritation caused from breathing dry air during the therapy session is largely eliminated.

The door 9 to the chamber 1 is then returned to its closed position shown in FIG. 1 and FIG. 2. This is accomplished by pulling the handgrip 47, on the interior of the door 9 proximate the guide 63, horizontally away from the front of the guide rod 57. This causes the guide 63 to slide along the track 62, and the lineal bearing 48 and 55, to slide towards the front of the guide rods, 50 and 57. When the door 9 is roughly in the position shown in phantom in FIG. 4, the handgrips 47 on the exterior of the door 9 can be utilized to facilitate the further closing of the door. This causes the exterior of the door 9 to contact the door gasket 65 along its entire length.

The air pump 13 is then activated, forcing air through the charcoal air filter 15 and the refrigeration unit 17. The air filter 15 cleans the air and removes any dust or oil particles entrained with the air. The refrigeration unit 17 cools the air to counteract the heating effect created by compressing the air within the chamber 1 and the increased metabolic rate of the patient.

The cooled pressurized air flows through the connecting tubing to the control panel 33 and the check valve 45. The cooled air is then emitted into the chamber through adjustable nozzles 18 and 20 which can be directed by the patient for his comfort.

As the pressure within the chamber 1 increases, the air pressure within the chamber 1 forces the door 9 against the door gasket 65 and creates an airtight seal.

The pressure within the chamber 1 is gradually increased until the chamber pressure reaches the desired level of pressure. This level of pressure is maintained throughout the course of the therapy session. Although some studies have shown that the benefits of hyperbaric oxygen therapy can be accelerated by performing the treatments at a higher pressure level, and the chamber 1 is preferably designed to withstand at least three atmospheres of pressure, two atmospheres or less is the prevailing accepted level of pressure for hyperbaric oxygenation treatment.

A trained medical attendant remains in visual contact with the patient throughout the therapy session. While sitting within the chamber 1, the patient may read or watch television through the chamber's transparent door 9. Because of the length of these sessions, the comfort of the patient during the session is a major consideration in deciding whether to treat the patient's condition through hyperbaric oxygenation or by other means. Patients are apt to be far more comfortable and far less susceptible to claustrophobic sensations while they relax in a comfortable seat 27 and watch their favorite television program, than they are apt to be while lying on their backs in standard mono-place chambers.

At the end of the therapy session, the pressure is gradually released from the chamber 1 by opening the pressure bleed valve 41. In the event of an emergency, necessitating the need to enter the chamber immediately, the pressure can be released by opening the full release value 43. In the event that the patient passes out, or has a seizure, and falls against the head 3 of the chamber 1 next to the guide rod 57, the pressure can be quickly released from the chamber 1, and the exterior hand grip 47 proximate the guide 63 can be lifted so that the guide 63 can be lifted out of the track 62 so that the door 9 can be swung open like a standard hinged door. This allows the attendant to pull the patient from the head 3 of the chamber 1 and then the open the door 1 in the ordinary manner.

During the course of the therapy session, air is vented from the chamber 1 through the screened ventilation outlet 67 and the outflow check value 44 to the control panel 33 and then into the atmosphere. The rate of this outflow can be monitored by examination of the outflow pressure gage 39 and can be altered by manipulating the chamber outflow control value 37. This continuous venting of the chamber 1 assures that the gases within the chamber 1 do not approach toxic levels.

The present invention provides a portable comfortable economical chamber for hyperbaric oxygen therapy. Since the chamber is pressurized with air rather than pure oxygen, the problems of fire safety and oxygen buildup within the chamber are minimized. Yet the patient, by breathing humidified pure oxygen in a pressurized environment, receives the full benefits of hyperbaric oxygen therapy.

It is believed that making hyperbaric oxygen treatment affordable for the average patient and accessible to the individual practitioner will permit the benefits of hyperbaric oxygenation to be enjoyed by a vastly larger cross-section of patients than heretofore has been possible, and will lead to a greater understanding of the full range of benefits available from hyperbaric oxygen therapy.

What is claimed is:

1. A hyperbaric oxygen chamber, comprising:

two pressure vessel heads having a cylindrical lip;

a cylindrical wall connecting said heads, said wall secured to the interior of said lips to reinforce said wall;

two segmental plates bent along their straight edges to form a flange, each of said plates secured to the interior surface of one of said lips, said bends giving added rigidity to said plates, said plates and said wall comprising an entry to said chamber;

a sealing surface around the inside periphery of said entry; and an inwardly opening door that seals against said surface, said chamber is pressurized with air to a level of two atmospheres and including means for delivering pure oxygen to a patient within said chamber, said chamber fitting through a single door opening in a direction perpendicular to the axis of said wall, said chamber also comprising:

a guide rod;

two supports supporting the ends of said guide rod secured to said wall;

a first bracket secured to the interior surface of said door, and having a portion which extends horizontally outward from said door;

a second bracket, pivotably secured against said horizontally extending portion of said first bracket, having a portion which extends downward and is slideably mounted on said guide rod;

a track extending along said entry; and a guide secured to said door for sliding within said track.

2. The chamber of claim 1, comprising:

a guide secured to a corner of said door;

means parallel to said entry along which said guide is movable; and means perpendicular to said entry along which a second corner of said door is movable.

3. The chamber of claim 1, comprising:

a second guide rod;

two supports supporting the ends of said second guide rod secured to said wall;

a third bracket secured to the interior surface of said door, and having a portion which extends horizontally outward from said door;

a fourth bracket, pivotably secured against said horizontally extending portion of said first bracket, having a portion which extends upward and is slideably mounted on said second guide rod.

* * * * *